United States Patent [19]

Bettis et al.

[11] 3,932,014

[45] Jan. 13, 1976

[54] HIGH CURRENT CAPACITY ELECTRICAL CONNECTOR

[75] Inventors: Edward S. Bettis, Oak Ridge; Harry L. Watts, Lake City, both of Tenn.

[73] Assignee: The United States of America as represented by the United States Energy Research and Development Administration, Washington, D.C.

[22] Filed: Mar. 20, 1975

[21] Appl. No.: 560,428

[52] U.S. Cl. ..... 339/22 B; 339/48; 339/92 R; 339/278 C

[51] Int. Cl.[2] ..... H01R 7/08

[58] Field of Search ..... 339/17 LM, 17 M, 22 B, 339/48, 49 B, 92, 263, 278 C

[56] References Cited

UNITED STATES PATENTS

| | | | |
|---|---|---|---|
| 2,097,324 | 10/1937 | Hill | 339/22 B |
| 2,945,137 | 7/1960 | Farnsworth | 339/22 B |
| 3,324,445 | 6/1967 | Miller | 339/125 R |
| 3,356,983 | 12/1967 | Johnson, Jr. | 339/17 M |

*Primary Examiner*—Joseph H. McGlynn
*Attorney, Agent, or Firm*—Dean E. Carlson; David S. Zachry; David E. Breeden

[57] ABSTRACT

An electrical connector is provided for coupling high current capacity electrical conductors such as copper busses or the like. The connector is arranged in a "sandwiched" configuration in which a conductor plate contacts the busses along major surfaces thereof clamped between two stainless steel backing plates. The conductor plate is provided with a plurality of contact buttons affixed therein in a spaced array such that the caps of the buttons extend above the conductor plate surface to contact the busses. When clamping bolts provided through openings in the sandwiched arrangement are tightened, Belleville springs provided under the rim of each button cap are compressed and resiliently force the caps into contact with the busses' contacting surfaces to maintain a predetermined electrical contact area provided by the button cap tops. The contact area does not change with changing thermal or mechanical stresses applied to the coupled conductors.

3 Claims, 2 Drawing Figures

HIGH CURRENT CAPACITY ELECTRICAL CONNECTOR

This invention was made during the course of, or under, a contract with the United States Atomic Energy Commission.

BACKGROUND OF THE INVENTION

This invention relates generally to apparatus for coupling electrical conductors and more specifically to a connector especially adapted for the electrical coupling of high current capacity conductors subject to varying thermal and mechanical stresses.

The coupling of electrical conductors, especially copper bars or large contact surface terminal connectors for cables, or the like, which carry very high currents presents certain problems. A voltage drop at the interface between conductors generates heat which produces problems other than the obvious loss of efficiency. For example, the thermal expansion of the heated conductors not only subjects the conductor terminals themselves to deformation, but also may subject the clamping or connecting device to distortion. A change to a lower temperature, by cooling or ceasing the flow of current, will cause the conductors and/or the connecting structure to contract; thereby changing the actual conducting surface contact. When two conductors are placed together along conducting surfaces, it is virtually impossible to obtain more than a few points of contact between the two conducting surfaces due to irregularities which inevitably exist, regardless how well the two conducting surfaces are clamped together. The currents are concentrated at the points of contact and the heat generated by the current flow is also concentrated at the points of contact; thereby subjecting the terminals to uneven rates of thermal expansion which magnifies the problem referred to above. Referring to a more specific electrical connection problem for which this invention was conceived, it is necessary to provide an electrical connector for rather larger high current capacity conductors in a toroidal nuclear fusion test reactor, the ORMAK F/BX. In the reactor, the toroid is made up of four quadrant subassembly sections which require a considerable number of connections of winding segments at the four quadrant joints. The coil terminals to be joined are flat water-cooled copper conductors designed to carry approximately 300,000 amperes. The specified contact pressure between terminals and connector is 2000 psi. In addition to these requirements, the connections between sections must be made by a remote controlled machine. A further condition is that the connector be constructed from nonmagnetic parts since the coils are subjected to extremely high magnetic fields.

SUMMARY OF THE INVENTION

In view of the above, it is an object of this invention to provide an electrical connector which maintains a selected current conducting surface area between connected conductors subjected to varying thermal and mechanical stresses.

Further, it is an object of this invention to provide an electrical connector for connecting high current terminals which not only maintains a selected current-conducting surface area between terminals but provides resilient electrical contacting means to maintain a selected contacting pressure.

Other objects and many of the attendant advantages of the present invention will be obvious from the following detailed description taken in conjunction with the accompanying drawings.

DETAILED DESCRIPTION

Figure 1:
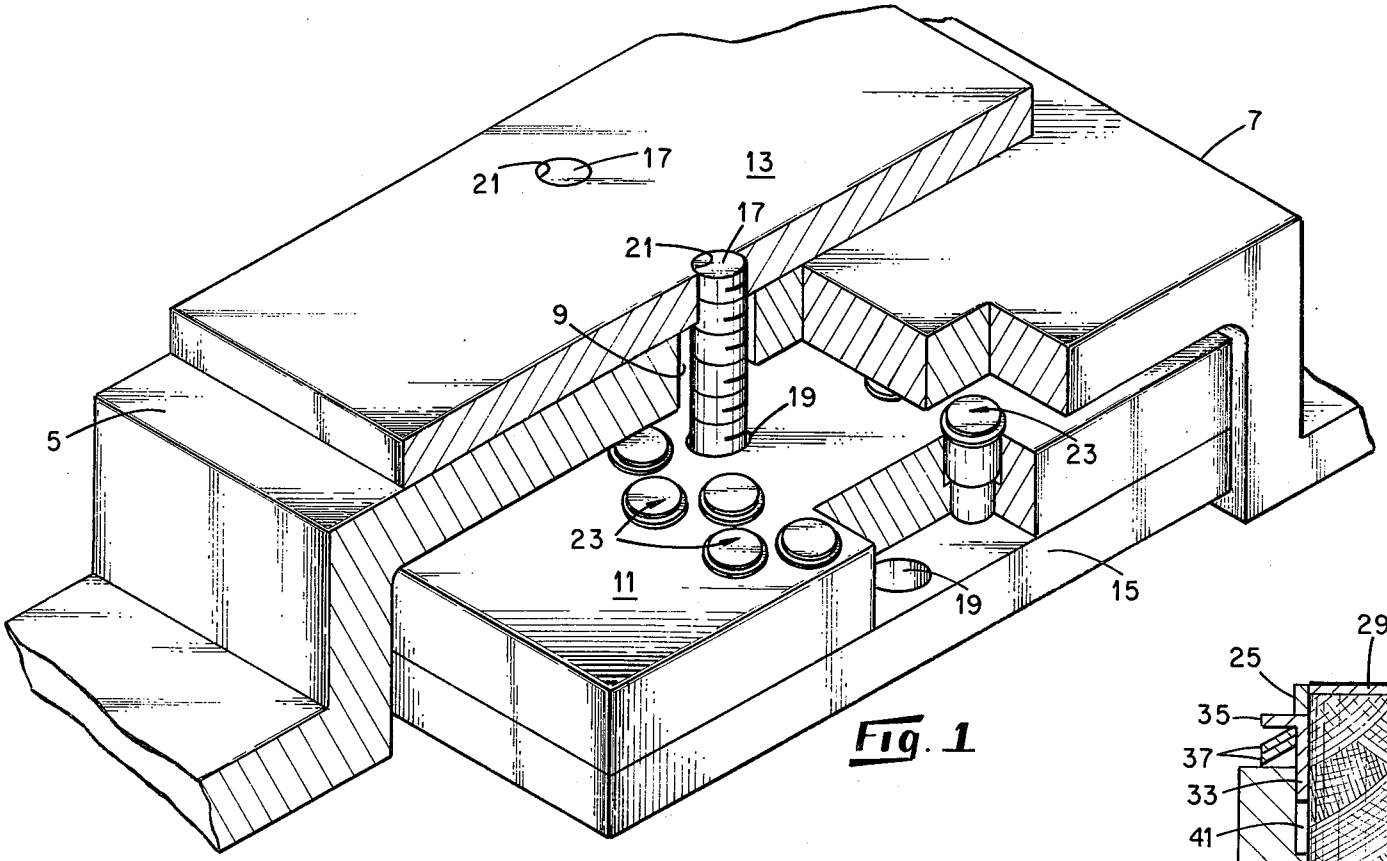
FIG. 1 is an isometric sectional view of a high current conductor connector clamp according to the present invention.

Referring now to FIG. 1, the invention will be illustrated by way of an example of connecting copper bus bars employed as terminals for the ohmic heating windings of the ORMAK fusion test reactor to connect the coil quadrant sections, as described above. The terminals to be connected are copper bus bars 5 and 7 which are shaped to align with each other in a near abutting arrangement, leaving a slot 9 therebetween. The connector is in the form of a clamp which receives and clamps the conductors 5 and 7 for electrical connection. The clamp comprises a copper conductive plate 11 between two stainless steel backing plates 13 and 15. Along the center of the clamp is a row of silicon bronze bolts 17 which extend through aligned openings 19 of the plate 11 and backing plate 15 and slot 9 to threadably engage the other backing plate 13 at aligned threaded openings 21. When the bolts 17 are tightened, the bars 5 and 7 are clamped between the upper backing plate 13 and the conductive plate 11. A preselected torque on bolts 17 provides a predetermined clamping force of the conductor bars 5 and 7 against contactor buttons 23 resiliently mounted in the conductive connector plate 11.

The plate 11 has two arrays of contact buttons 23, one set which contacts conductor 5 and another which contacts conductor 7. The current path from one conductor to the other is through the respective contact buttons and plate 11.

Figure 2:
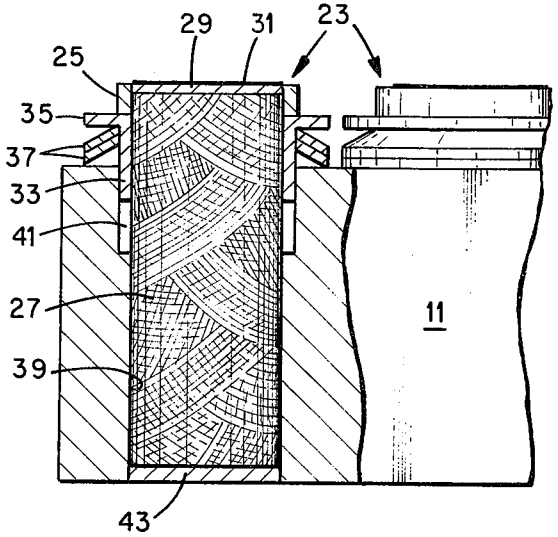
FIG. 2 is a detailed sectional view of one of the contact buttons of the connector of FIG. 1.

Referring now to FIG. 2, wherein one of the buttons 23 is shown in section, the contact button will be described in detail. Each button has a top portion which extends above the connector plate 11 surface. To form the top contacting surface of each button, a copper ring 25 is copper brazed to one end of a length of extra-flexible copper cable 27. An excess of brazing alloy is left to form a cap 29. The cap 29 is machined to form a smooth level surface and preferably coated with a 94% silver, 6% cadmium oxide solder which is sintered to form the actual contacting surface 31. A stainless steel sleeve 33 is slipped over the cable 27 and is provided with a radially outwardly extending flanged portion 35 at one end thereof which abutts with the ring 25. At least one Belleville spring 37, FIG. 2 shows two springs, is slipped over sleeve 37 and abutts with the lower surface of flange 35. The springs 37 are preferably constructed from a beryllium copper alloy to prevent magnetization and yet provide the desired resilience.

The cable 27 of each button with the upper cap assembly as above described is positioned in an opening 39 in plate 11 so that the srings 37 rest against the plate 11 surface. The cable 27 is cut just short of the lower surface of plate 11 and copper brazed at 43 to the plate 11. The opening 39 has a countersunk portion 41 to slidably receive a portion of the sleeve 33 and expansion of the cable 27 when the buttons are compressed by the connector clamping force.

Thus, it will be understood that each contact button has a cap surface 31 which is designed to contact and conduct currents between a flat conductor terminal surface and the connector plate 11. The number and surface area of each button cap will depend upon the conductor terminal sizes and the required current flow. An important feature of this connector is that each button 23, being resiliently mounted, affords some degree of antiparallism between the terminals to be connected and the conductor plate 15, thereby preventing the usual change in conductor contacting surface due to thermal and mechanical stresses.

Although the invention has been illustrated by way of a particular example, it will be understood that various modifications and changes may be made and some features may be used in different combinations without departing from the spirit and scope of the invention as defined in the claims.

What is claimed is:

1. A high current capacity electrical connector for connecting a plurality of terminals, comprising:

a pair of backing plates;

a current-conducting plate disposed on one side of one of said backing plates, said backing plates disposed to receive said plurality of terminals in a sandwiched arrangement therebetween with a major surface of each of said plurality of terminals adjacent said conductor plate;

a plurality of smooth-surfaced contact buttons resiliently mounted in said conductive plate in a spaced array to provide electrical contact with said major surface of each of said plurality of terminals above said adjacent surface of said conductor plate; and means for applying a clamping force to said backing plates so that the contacting surface of said buttons is forced against said terminals to provide electrical connection therebetween through said connector plate.

2. The electrical connector as set forth in claim 1 wherein each of said contact buttons includes a length of flexible electrically conductive cable disposed in a corresponding opening in said conductive plate in an electrically conductive arrangement therewith and extending above said adjacent surface of said conductive plate, an electrically conductive cap disposed over and electrically connected to the extended portion of said cable to form a smooth contacting surface; a sleeve disposed about said cable abutting said cap and slidably extending into a countersunk portion of said corresponding opening in said conductive plate, said sleeve having a radially outwardly extending flange at the end of said sleeve abutting said cap, and at least one Belleville spring disposed between said flange and said adjacent surface of said conductive plate.

3. The electrical connector as set forth in claim 2 wherein said terminals are copper bus bars and wherein said contact surfaces of each of said buttons further includes a silver and cadmium oxide solder coating.

* * * * *